US005154520A

United States Patent [19]

Muto et al.

[11] Patent Number: 5,154,520

[45] Date of Patent: Oct. 13, 1992

[54] MULTICOLOR PRINTING APPARATUS HAVING A MULTICOLOR RIBBON SHIFTING MECHANISM

[75] Inventors: Naruhito Muto; Makoto Hattori, both of Nagoya, Japan

[73] Assignee: Brother Kogyo Kabushiki Kaisha, Nagoya, Japan

[21] Appl. No.: 669,617

[22] Filed: Mar. 14, 1991

[30] Foreign Application Priority Data

Mar. 27, 1990 [JP] Japan ..... 2-78340

[51] Int. Cl.[5] ..... B41J 35/18

[52] U.S. Cl. ..... 400/216.1; 400/216.2; 400/211

[58] Field of Search ..... 400/216, 216.1, 216.2, 400/216.3, 216.4, 216.5, 217, 217.1, 701, 702, 702.1, 211

[56] References Cited

U.S. PATENT DOCUMENTS 4,568,209 2/1986 Zerillo ..... 400/216.1

4,707,159 11/1987 Hirano et al. ..... 400/702

FOREIGN PATENT DOCUMENTS 55-146782 11/1980 Japan .

0053453 3/1983 Japan ..... 400/701

59-78882 5/1984 Japan .

0022975 1/1986 Japan ..... 400/701

0174177 7/1987 Japan ..... 400/701

0211181 9/1987 Japan ..... 400/701

0056478 3/1988 Japan ..... 400/701

*Primary Examiner*—Edgar S. Burr

*Assistant Examiner*—John S. Hilten

*Attorney, Agent, or Firm*—Oliff & Berridge

[57] ABSTRACT

A multicolor printing apparatus having a multicolor ribbon shifting mechanism is disclosed wherein the multicolor ribbon is selectively separated from a print paper to be printed on prior to shifting the multicolor ribbon to change colors based upon a shift amount which is required to shift the multicolor ribbon from a current position to a next position in order to print characters having a desired color.

15 Claims, 8 Drawing Sheets

MULTICOLOR PRINTING APPARATUS HAVING A MULTICOLOR RIBBON SHIFTING MECHANISM

BACKGROUND OF THE INVENTION

1. Field of the Invention

The present invention relates to a multicolor printing apparatus and, more particularly, to a multicolor ribbon shifting mechanism.

2. Description of the Related Art

A multicolor ribbon having a region coated with yellow ink, a region coated with magenta ink and a region coated with cyan ink arranged in the widthwise direction of the ribbon are typically used as ribbons in multicolor printers. Alternatively, another multicolor ribbon which can be used in multicolor printers has regions coated with yellow, magenta, cyan and black ink, and the like. Each colored region of the ribbon is arranged to be opposed to print paper and is shifted as required by a ribbon shift mechanism which is included in the multicolor printer to control the color being printed A multicolor dot matrix printer provided with the ribbon shift mechanism described above is disclosed in U.S. Pat. No. 4,568,209. In this printer, the ribbon shift mechanism is driven by a stepping motor so that the region of the multicolor ribbon having a desired color is opposed between the operative portion of the printhead and the print paper. The printer is further provided with a ribbon position detector and a pulse calculator. The ribbon position detector counts the drive pulses supplied to the stepping motor to detect the current position of the ribbon. The pulse calculator calculates the number of drive pulses which must be supplied to the stepping motor in order to perform a ribbon shift operation. The calculator calculates the number of drive pulses based upon the current position of the ribbon as detected by the ribbon position detector and the region of color on the multicolor ribbon to be used for the next print operation. Upon calculation of the number of drive pulses required to be supplied to the stepping motor by the pulse calculator, the calculated number of drive pulses are input into the stepping motor in the same manner irrespective of the magnitude of the drive pulse, and the stepping motor is rotated accordingly. Additionally, in order to maintain a high print speed, the ribbon is shifted while it is in contact with the print paper except during a carriage return operation when the ribbon is located spaced from the print paper.

However, when the ribbon is shifted while it is in contact with the print paper, a number of problems occur. When the ribbon is moved at a high speed during, for example, a large widthwise movement, that is, a large shift amount of the ribbon, the ribbon may be turned over (folded over) due to the friction between the ribbon and the print paper. Particularly, when the ribbon is shifted while it is in contact with seams formed in a continuous paper web, there is a high possibility of the above-described turning-over of the ribbon. Furthermore, when the ribbon is shifted by a large shift amount, ink located on the ribbon is transferred to the print paper at random causing undesirable ink smudges on the print paper. The problems described above occur more frequently as the shift amount of ribbon is larger, for example, when the ribbon is shifted substantially across its entire width.

OBJECTS AND SUMMARY OF THE INVENTION

For the purpose of solving the above problems, the ribbon should be separated from the print paper during the ribbon shift operation. However, the process of separating the ribbon from the print paper takes time. Accordingly, separating the ribbon from the print paper for every shift operation performed on the ribbon causes a reduction in the print speed.

An object of the present invention is to provide a multicolor printing apparatus capable of securely executing a shift operation of a multicolor ribbon while restraining a reduction of a print speed to a minimum.

Another object of the present invention is to provide a multicolor printing apparatus capable of executing a shift operation of a multicolor ribbon while restraining a reduction of a print speed to a minimum and without smudging the print paper.

In order to achieve the above and other objects, and to overcome the shortcomings discussed above, a multicolor printing apparatus according to this invention for executing a multicolor print operation with respect to print paper by using a multicolor ribbon divided into a plurality of color regions in the widthwise direction thereof comprises a printhead, a ribbon shift means for shifting the multicolor ribbon in the widthwise direction thereof to move a region of a desired color of the multicolor ribbon into a position opposed to the printhead, separating means for separating the multicolor ribbon from the print paper, and control means for controlling the ribbon shift means for shifting and the separating means for separating, wherein said means for controlling determines a current widthwise position of the multicolor ribbon and a next widthwise position of the multicolor ribbon to which the multicolor ribbon must be shifted to print a desired color, calculates a shift amount of the multicolor ribbon based on the determined current and next widthwise positions, and controls the means for shifting and the means for separating based on the shift amount.

In the multicolor printing apparatus having the construction described above according to this invention, the ribbon shift means executes the shift operation of the multicolor ribbon by moving the multicolor ribbon in the widthwise direction. Prior to the operation of the ribbon shift means, the control means determines the current position of the multicolor ribbon and the next position of the multicolor ribbon and calculates a movement amount (or a shift amount) of the multicolor ribbon in the widthwise direction based on the current and next positions. The control means then determines whether to control the separating means to cause the multicolor ribbon to be separated from the print paper prior to controlling the ribbon shift means to cause the multicolor ribbon to be shifted to the next widthwise position based on the magnitude of the shift amount. When the multicolor ribbon is shifted while it is in contact with the print paper by a large shift amount, various problems described above occur. Consequently, if the control means determines that the shift amount of the multicolor ribbon is large (greater than a predetermined value), the separating means is controlled to separate the multicolor ribbon from the print paper, and then, the ribbon shift means is controlled to execute the shift operation of the multicolor ribbon while the ribbon is separated from the print paper.

In the multicolor printing apparatus according to the present invention, the multicolor ribbon is shifted while it is spaced apart from the print paper when the multicolor ribbon is shifted by the large shift amount. Accordingly, the multicolor ribbon cannot be turned over due to friction between the multicolor ribbon and the print paper, thereby enabling a stable shift operation of the multicolor ribbon to be performed. Additionally, it is possible to prevent any smudges from being formed on the print paper due to the ink of the multicolor ribbon being transferred onto the print paper because of the friction between the multicolor ribbon and the print paper. Therefore, a clear print image can be obtained. Moreover, since the multicolor ribbon is separated from the print paper only when the multicolor ribbon is shifted by a large shift amount, the time required for the shift operation of the multicolor ribbon is not increased excessively, thus achieving a print operation at a high speed.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Figure 1:
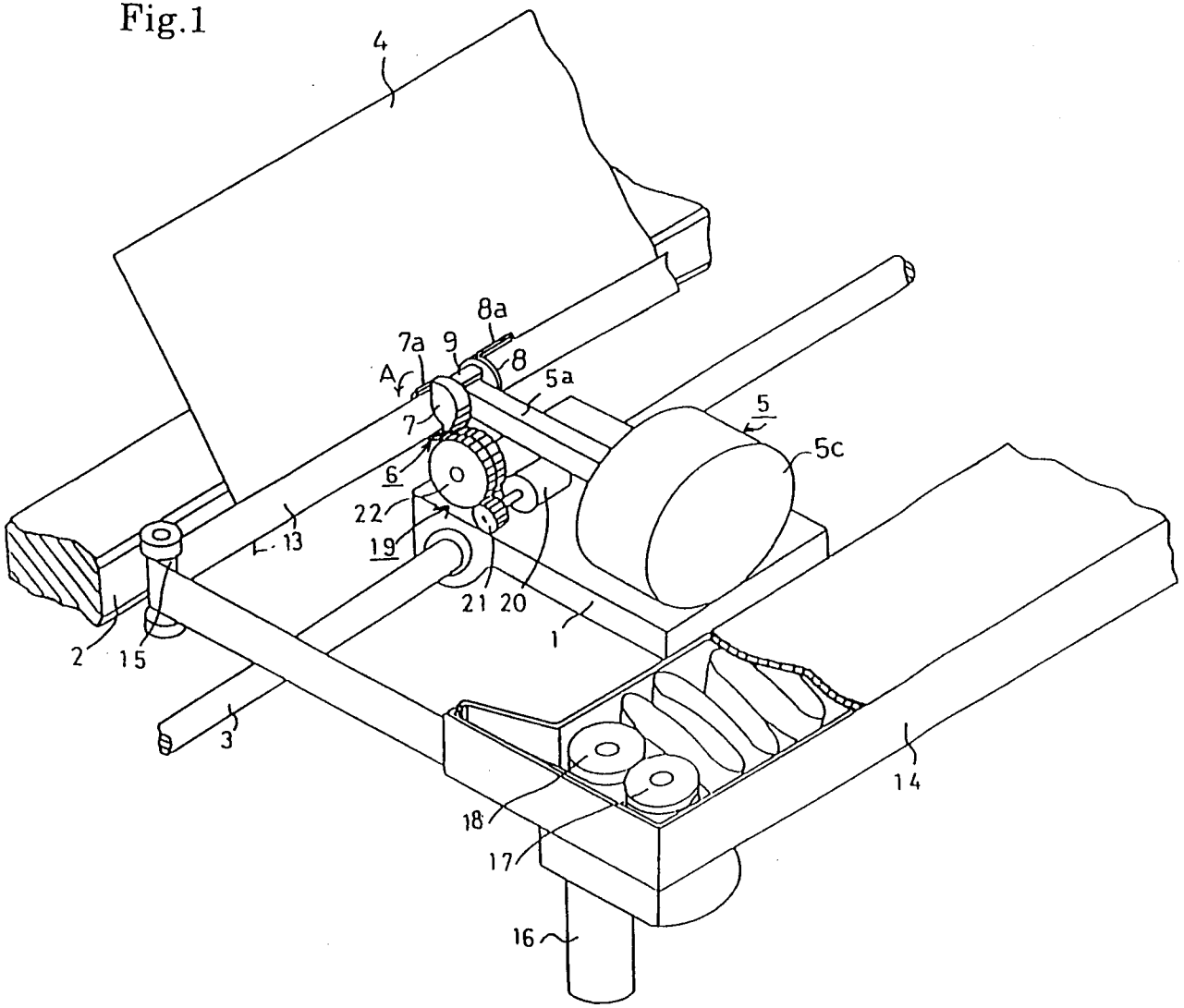
FIG. 1 is a perspective view illustrating major components of a multicolor dot matrix printer in a preferred embodiment according to the present invention.
Figure 2:
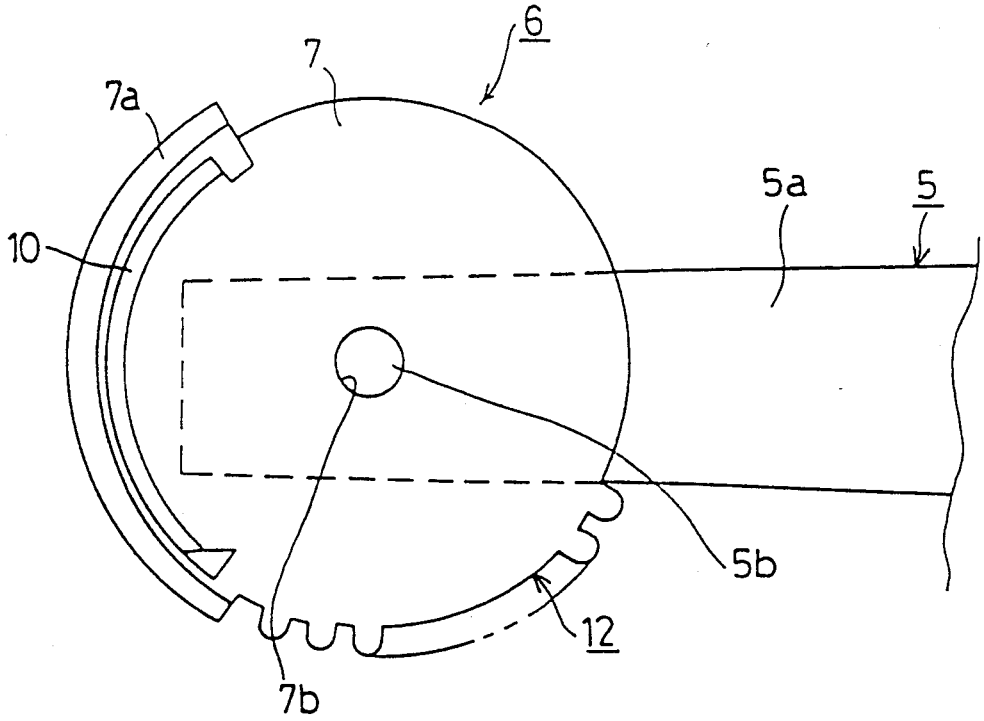
FIG. 2 is a side view showing a ribbon guide fixed to a printhead.
Figure 5:
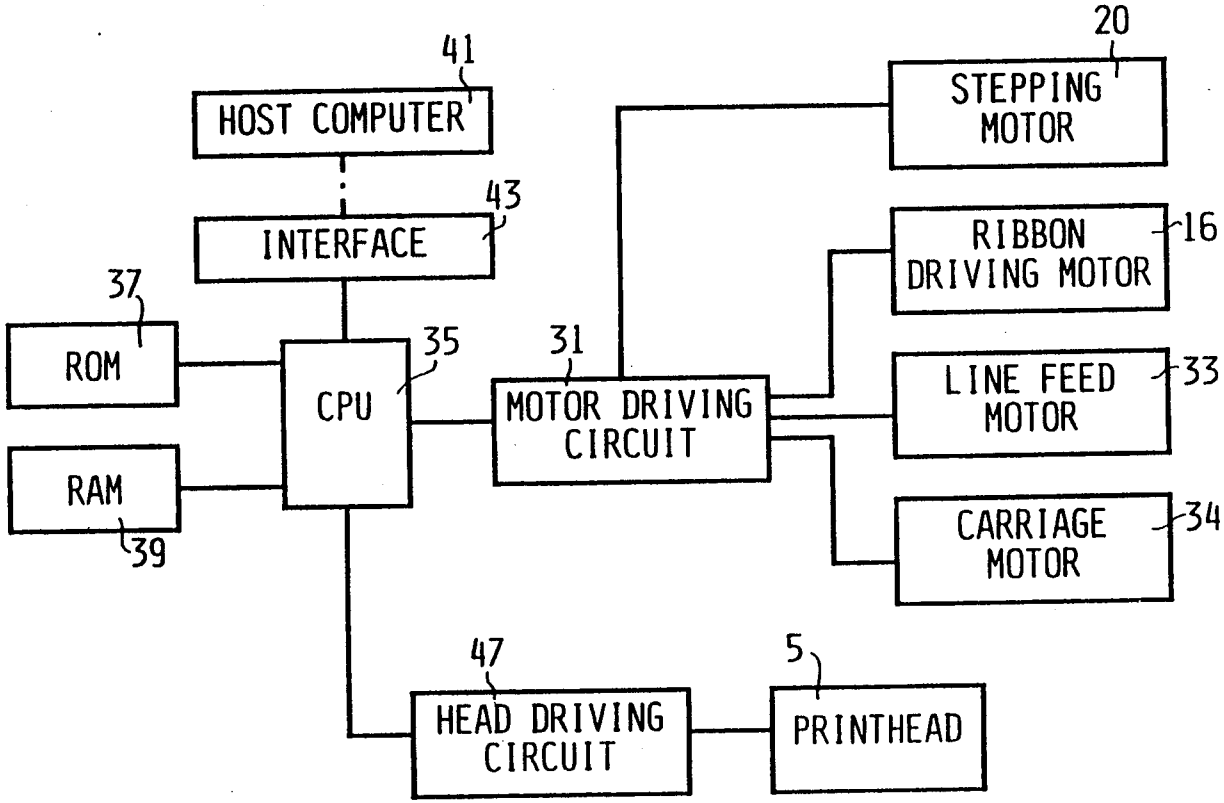
FIG. 5 is a block diagram showing the electrical constitution of a multicolor dot matrix printer.
Figure 8:
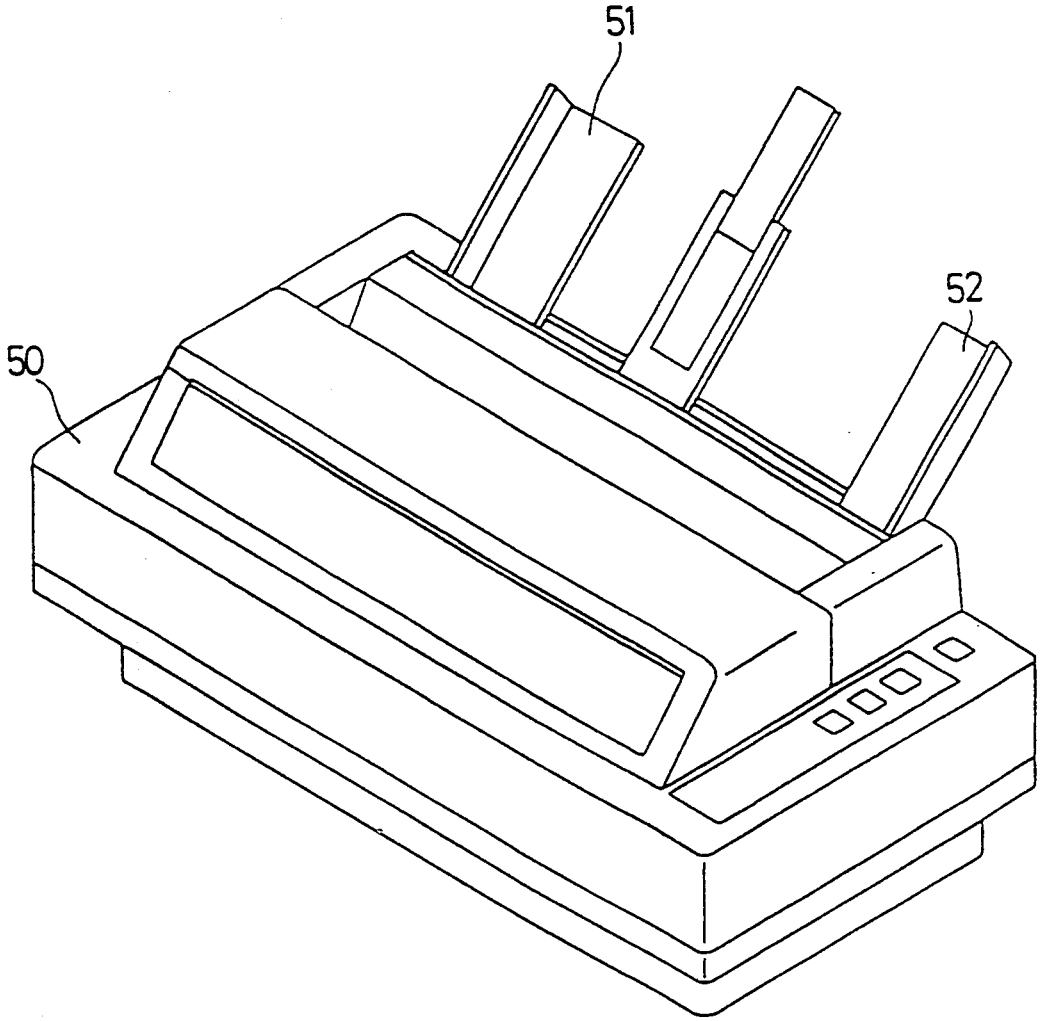
FIG. 8 is an exterior view of a multicolor dot matrix printer.

An embodiment will be described in which the present invention is employed in a multicolor dot matrix printer. As shown in FIGS. 1, 2 and 8, in the unit case 50 of a multicolor dot matrix printer are disposed a platen 2 and a guide rod 3 extending parallel to the longitudinal axis of the platen 2. A carriage is engaged with the guide rod 3. The carriage 1, which is driven by a carriage motor (as depicted in FIG. 5), traverses along a printing line of print paper 4, which is mounted on the platen 2, parallel to the longitudinal axis of platen 2 under the guidance of the guide rod 3.

A printhead 5 is fixed on the carriage 1 so as to move together with the carriage 1. Many print wires are contained inside the front frame 5*a* of the printhead 5. Meanwhile, in the rear frame 5*c* of the printhead 5, there are provided many electromagnetic solenoids for selectively driving the print wires. The printhead 5 prints characters or the like on the print paper 4 in a dot matrix manner through a multicolor ribbon 13 to be described later. A pair of shaft portions 5*b* for rotatably supporting a ribbon guide 6 (explained later) in the widthwise direction of the color ribbon 13 are integrally formed on the opposite sides of the end of the front frame 5*a*.

The ribbon guide 6 can be, for example, the same type as that disclosed in U.S. Pat. No. 4,568,209. The ribbon guide 6 is provided with right and left guide main bodies 7 and 8, a pair of ribbon guide portions 7*a* and 8*a*, and a bridge portion 9. Fixing holes 7*b* and 8*b* into which the pair of shaft portions 5*b* formed in the printhead 5 are inserted are located in each of the guide main bodies 7 and 8. The ribbon guide portions 7*a* and 8*a* are adapted to position the multicolor ribbon 13 in substantially the same plane as a print nosepiece 5*d* which is located at the tip end of the front frame 5*a* of the printhead 5.

The upper portion of the guide main body 7 and the upper portion of the guide main body 8 are connected to each other by the bridge portion 9. When the ribbon guide 6 is rotated by a predetermined angle around the shaft portions 5*b* in a direction indicated by an arrow A in FIG. 1, the bridge portion 9 abuts against the upper surface of the front frame 5*a* to serve as a stop for restricting the maximum downward rotational position of the ribbon guide 6.

As shown in FIG. 2, the ribbon guide main bodies 7 and 8 are disc-like in shape. A gear 12 is formed under the ribbon guide main body 7. In each of the ribbon guide main bodies 7 and 8, there is provided a guide passage 10 passing therethrough. The guide passage 10 is a groove formed along each end of the ribbon guide main bodies 7 and 8 on the side of the print paper 4, and has almost the same width as the multicolor ribbon 13. A slit (not shown) is formed in the guide passage 10, through which the multicolor ribbon 13 is inserted into the guide passage 10.

Figure 4:
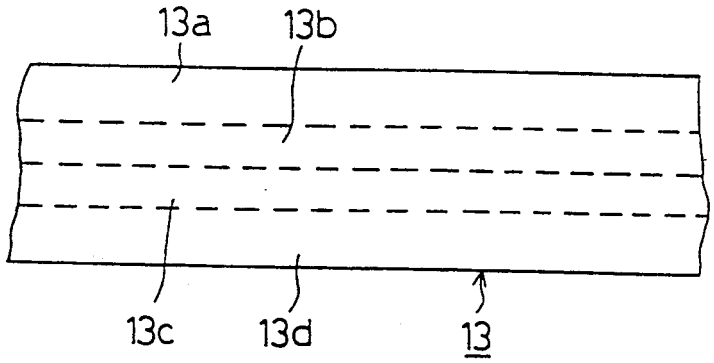
FIG. 4 is a view showing a multicolor ribbon.

As illustrated in FIGS. 1 and 4, the multicolor ribbon 13 includes first through fourth different colored ribbon regions (or stripes) 13*a*—13*d* in order from the topside in the widthwise direction thereof. The multicolor ribbon 13, which is of an endless loop type, is contained in a folded state in a ribbon cassette 14 which is detachably housed in the unit case 50. Guide shafts 15 are fixed in the unit case 50 on both sides of platen 2 and are spaced slightly apart (about 15 mm) from the platen 2. The multicolor ribbon 13 is stretched across the guide shafts 15, and is inserted through the guide passage 10 of the ribbon guide 6 to be located opposed to the printing nosepiece 5*d* of the printhead 5. Inside the ribbon cassette 14, there are contained a ribbon feeding roller 18 and a driven roller 17. The ribbon feeding roller 18 is rotatably driven by a ribbon driving motor 16 disposed in the unit case 50. The multicolor ribbon 13 is fed while being held between the ribbon feeding roller 18 and the driven roller 17 and is housed in the ribbon cassette 14 in a folded state.

Figure 3:
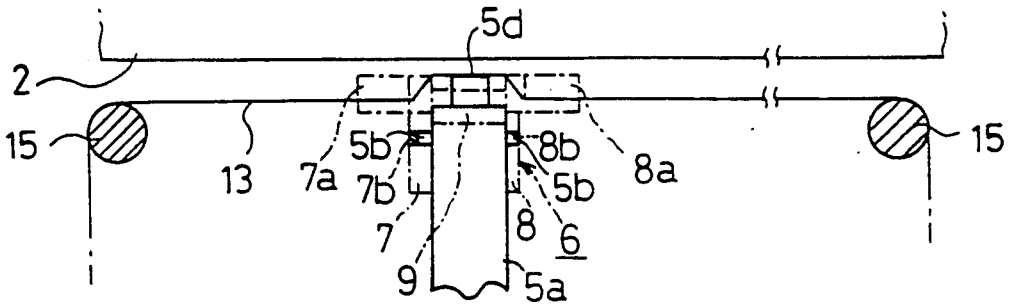
FIG. 3 is an illustration for assisting in explaining the relationship between a platen and a multicolor ribbon.

As shown in FIG. 3, the ribbon guide portions 7*a* and 8*a* are interposed between the multicolor ribbon 13 and the print paper 4 on both sides of the printhead 5. In front of the printhead 5, the multicolor ribbon 13 is supported by the ribbon guide 6 so as to be spaced apart from the print paper 4 by about 0.2 mm. Additionally, near both ends of the platen 2, the multicolor ribbon 13 is supported by the guide shafts 15 spaced apart from the platen 2 by about 15 mm. Therefore, the multicolor ribbon 13 is supported spaced apart from the print paper 4 by about 15 mm except for a part thereof which is opposed to the print nosepiece 5*d* of the printhead 5. Namely, the multicolor ribbon 13 is separated from the print paper 4 everywhere except at the front part of the printhead 5. Nevertheless, due to flapping of the multicolor ribbon 13, and unevenness of the print paper 4 such as seams or the like, the multicolor ribbon 13 may be brought into contact with the print paper 4, particularly adjacent to the nose piece 5*d* of printhead 5.

As illustrated in FIGS. and 2, the gear 12 formed in the guide main body 7 of the ribbon guide 6 is meshed with an idler gear 22 which is rotatably attached to the carriage 1. The idler gear 22 is engaged with a driving gear 21 which is fixed to the rotary shaft of a stepping motor 20 disposed in the carriage. Upon energization of the stepping motor 20, the gear 12 is rotated via the driving gear 21 and the idler gear 22 so that the ribbon guide 6 as a whole is rotated around the shaft portions 5*b* of the printhead 5. With rotation of the ribbon guide 6, the multicolor ribbon 13 inserted through the guide passage 10 of the ribbon guide 6 is moved in the widthwise direction thereof. Thus, by driving the stepping motor 20, any of the ribbon regions 13*a* to 13*d* of the multicolor ribbon 13 can be positioned between the print paper 4 and the tip end of the printhead 5. Accordingly, stepping motor 20, idler gear 22 and guide 6 constitute a ribbon shift mechanism 19 which functions as ribbon shifting means for shifting multicolor ribbon 13 in the widthwise direction, with stepping motor 20 functioning as a drive means thereof.

Next, the electrical constitution of the multicolor dot matrix printer according to this invention will be explained referring to the block diagram shown in FIG. 5. The stepping motor 20 and the ribbon driving motor 16 are connected to a motor driving circuit 31. Furthermore, connected to the motor driving circuit 31 are a line feed motor 33 for moving the print paper 4 in a direction perpendicular to the longitudinal direction of the platen 2 and a carriage motor 34 for moving the carriage 1 with the printhead 5 mounted thereon in the longitudinal direction of the platen 2. The motor driving circuit 31 is connected to a CPU (central processing unit) 35, and rotates the motors 16, 20, 33 and 34 on the basis of a signal output from the CPU 35. The CPU 35 is connected to an exterior host computer 41 through an interface 43 and a connecting line. A ROM (read only memory) 37 and a RAM (random access memory) 39 are also connected to CPU 35. The ROM 37 stores therein a program for operating the CPU 35 and dot patterns of characters which can be printed. The RAM 39 can be utilized both as a memory area in the operating region of the CPU 35 and as a buffer for temporarily storing lines of character cords received from the host computer 41. Moreover, to the CPU 35 is connected the printhead 5 via a head driving circuit 47.

Next, the operation of the multicolor dot matrix printer according to this invention will be explained. As illustrated in FIGS. to 3, in order to dispose the multicolor ribbon 13 in the ribbon guide 6, the multicolor ribbon 13 is inserted into the guide passage 10 through the slit of the ribbon guide 6 so as to be positioned in ribbon guide portions 7*a* and 8*a* and to be disposed at substantially the same plane as the print nosepiece 5*d* of the printhead 5. The ribbon cassette 14 is housed inside the unit case 50, and the multicolor ribbon 13 is stretched across the pair of guide shafts 15. Next, the fixing holes 7*b* and 8*b* of the ribbon guide 6 are inserted onto the pair of shaft portions 5*b* formed in the printhead 5 so that the ribbon guide 6 is rotatably provided with respect to the tip end of the printhead 5, and thus, the multicolor ribbon 13 is located opposed to the print nosepiece 5*d* of the printhead 5. With disposition of the ribbon guide 6 in the printhead 5, the gear 12 formed in the guide main body 7 can be meshed with the idler gear 22 in an arbitrary position.

After disposition of the ribbon guide 6 in the tip end of the printhead 5, upon attachment of printer to a power source, the CPU 35 illustrated in FIG. 5 rotates the stepping motor 20 by an open-loop control. By this open-loop control, the stepping motor 20 is rotated more than the number of steps corresponding to the distance from the first ribbon region 13*a* to the fourth ribbon region 13*d* of the multicolor ribbon 13 so as to rotate the ribbon guide 6 around the shaft portion 5*b* in a direction indicated by an arrow A as shown in FIG. 1. As a result, when the first ribbon region 13*a* is opposed to the print nosepiece 5*d* of the printhead 5, the bridge portion 9 of the ribbon guide 6 is abutted against the upper surface of the front frame 5*a* of the printhead 5 so that a maximum downward rotary position of the ribbon guide 6 is achieved. Because the bridge portion 9 restricts the rotation of the ribbon guide 6 and the stepping motor 20 is stepped out, the position where the bridge portion 9 abuts against the front frame 5*a* is regarded as a rotary reference position of the stepping motor 20.

When the print data consisting of character cords and control cords is input into the CPU 35 from the host computer 41 through the interface 43, the CPU 35 stores the print data in the buffer of the RAM 39. The CPU 35 reads out the character cords stored in the buffer of the RAM 39, and then, reads out a dot pattern corresponding to the character cords from the ROM 37. The CPU 35 inputs the dot pattern to the printhead driving circuit 47 and drives the printhead 5 accordingly. The CPU 35 rotates the carriage motor 34 via the motor driving circuit 31 to move the carriage 1 with the printhead 5 mounted thereon in synchronism with the drive of the printhead 5. The CPU 35 drives the line feed motor 33 each time one line is printed to feed the print paper 4 by one line. This process is well known; therefore a detailed description thereof is omitted.

Figure 6:
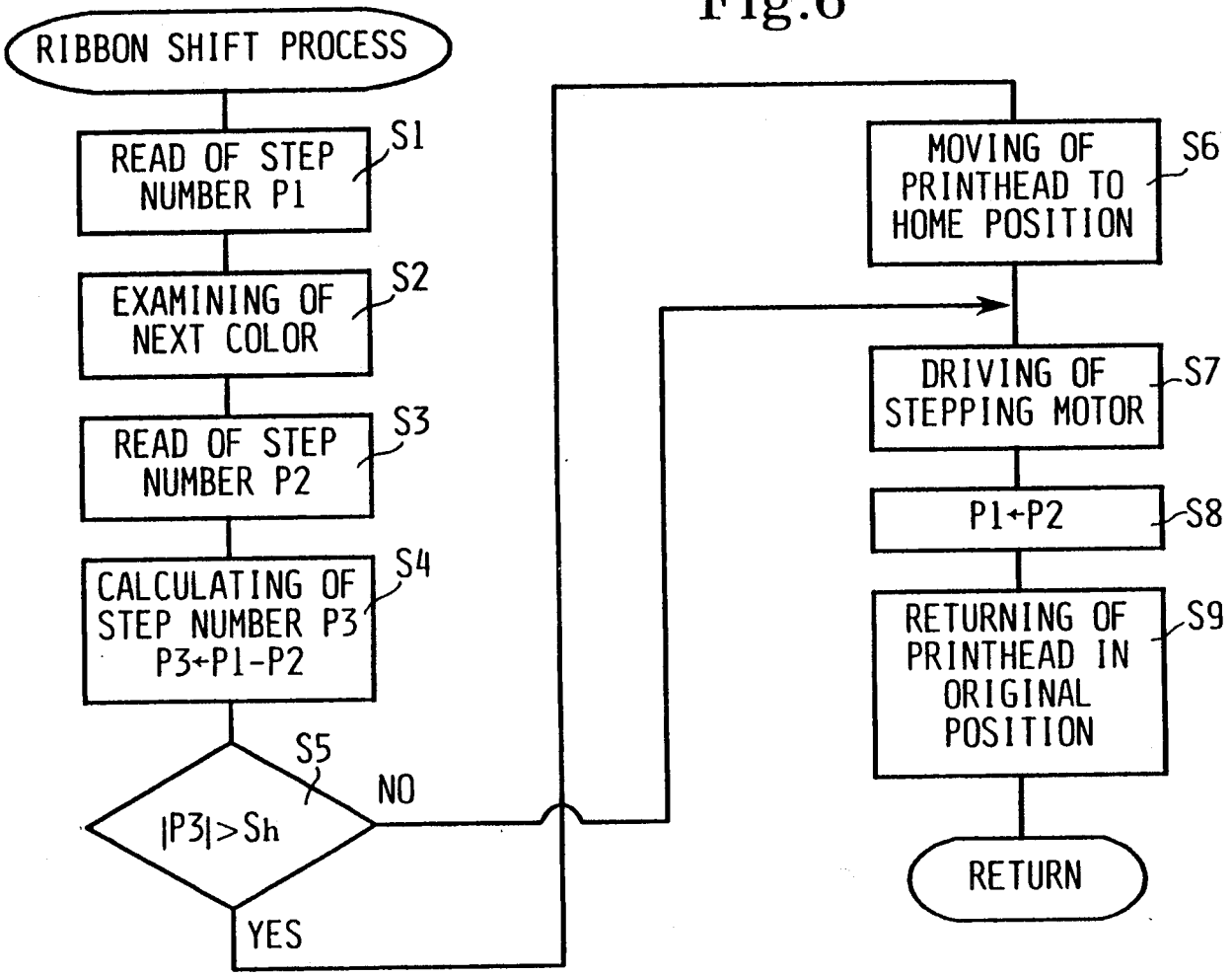
FIG. 6 is a flowchart showing the operation of a multicolor dot matrix printer according to the present invention.

In the situation where a shift operation of the multicolor ribbon 13 is required, the CPU 35 executes a ribbon shift process shown in the flowchart of FIG. 6. The ribbon shift process can be executed not only at the time of returning of the carriage, but also during movement of the carriage when printing a line. First, the CPU 35 reads out the step number Pl, indicative of the current shift position of the multicolor ribbon 13, which is stored in the RAM 39 (Step 1, hereinafter referred to as S1). In the first ribbon shift process after turning-on of the printer, the step number P1 is set to an initial value 0 (which corresponds to the above-described rotary reference position). In the second or following ribbon shift process, the step number Pl varies according to a process S8 described later. The step number Pl herein signifies the drive step number of the stepping motor 20 (i.e., the number of steps) required for moving the multicolor ribbon 13 from the rotary reference position to the current position.

The CPU 35 analyzes the control cords of the print data fed from the host computer 41 and stored in the RAM 39 to determine a color appropriate for the next print (S2). The CPU 35 reads out from the ROM 37 the drive step number P2 of the stepping motor 20 which is necessary to move the multicolor ribbon from the rotary reference position to such a position so that the color region determined in S2 is opposed to the print nosepiece 5*d* of the printhead 5 (S3). Furthermore, the CPU 35 calculates the step number P3 which is the difference between the step number P1 (the current position) and the step number P2 (the next position) (S4). Thus, the step number P3 corresponds to the drive step number of the stepping motor 20 to be used in a process S7 explained later, and moreover, a plus or minus sign of the number P3 corresponds to the driving direction (rotary direction) of the stepping motor 20. Prior to driving the stepping motor 20, the CPU 35 compares the absolute value of the step number P3 with a predetermined threshold value Sh (S5). In the case of the printer according to this invention, the drive step number of the stepping motor 20 which is required for moving the multicolor ribbon 13 to a color region located adjacent to the current color region (i.e., one color region) is, for example, 7 pulses. The threshold value Sh is set at, for example, 12 pulses.

Figure 7:
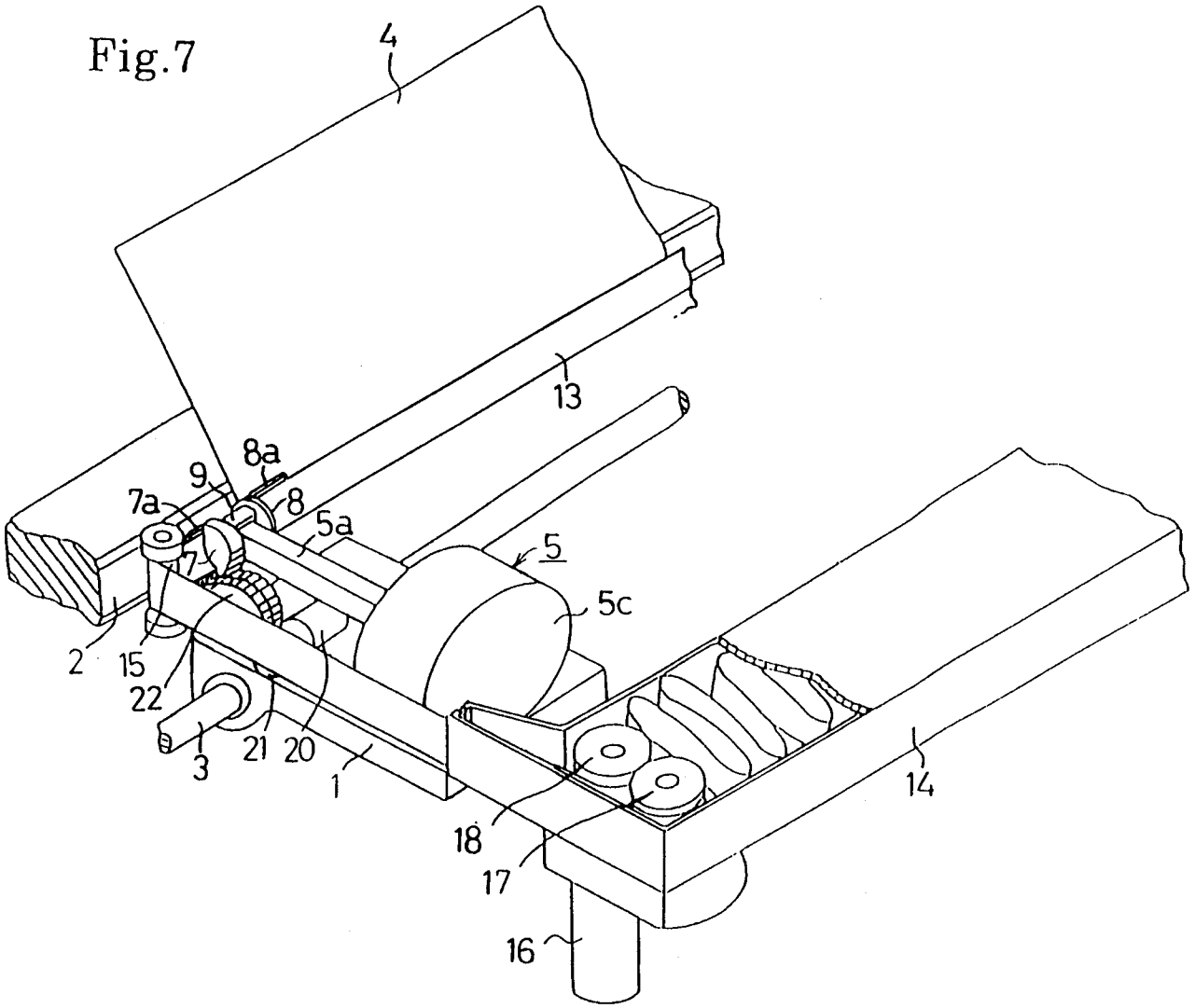
FIG. 7 is a perspective view showing a carriage located at a home position.

If it is determined in S5 that the step number P3 exceeds the threshold value Sh, the CPU 35 drives the carriage motor 34 via the motor driving circuit 31 so as to move the printhead 5 to a home position shown in FIG. 7 (S6). The CPU 35 drives the stepping motor 20 by the step number P3 calculated in S4 so as to rotate the ribbon guide 6, hence shifting the multicolor ribbon 13 (S7). At this time, the driving or rotary direction of the stepping motor 20 is determined according to the plus/minus sign of the step number P3. As shown in FIG. 8, a pair of paper guides 51 and 52 for restricting the position of the print paper 4 are mounted on the unit case 50. The left paper guide 51 inhibits the print paper 4 from intruding into the home position and thus functions as inhibiting means for inhibiting the print paper from intruding into the home position. Consequently, when the multicolor ribbon 13 is shifted with the printhead 5 located at the home position as illustrated in FIG. 7, the multicolor ribbon 13 is prevented from being brought into contact with the print paper 4 even with large movement of the multicolor ribbon 13. Accordingly, it is seen how carriage motor 34 and driving circuit 31 function as a separating means for separating the multicolor ribbon 13 from print paper 4.

If it is determined in S5 that the step number P3 is smaller than the threshold value Sh, the CPU 35 drives the stepping motor 20 with the printhead 5 maintained in the print position without moving the printhead 5 to the home position, to thus shift the multicolor ribbon 13 (S7). In this case, the multicolor ribbon 13 opposed to the print nosepiece 5*d* of the printhead 5 moves in a state located close to the print paper 4 (at an interval of almost 0.2 mm therebetween). Therefore, the multicolor ribbon 13 may be brought into contact with the print paper 4 in front of the printhead 5 so that there is a possibility of the sticking of ink to the print paper 4. At this stage, however, since the shift distance of the multicolor ribbon 13 is very short, the amount of the ink which may be transferred to the print paper 4 is very small, so that any smudges placed on the print paper 4 do not attract any attention. Moreover, portions of the multicolor ribbon 13, other than the part opposed to the front of the printhead 5, are separated by about 15 mm from the print paper 4 as described above, and thus any ink from these portions cannot be transferred to the print paper 4.

The CPU 35 stores the step number P2 into the RAM 39 as the new step number P1 (S8). And then, in the situations when printhead 5 is moved to the home position (i.e., when the answer to S5 is YES), the CPU 35 drives the carriage motor 34 to return the printhead 5 to the original position (S9), thereby leading to completion of the ribbon shift process. It should be noted that when the answer to S5 is NO, the printhead 5 will not have to be returned to the original position.

Thus, it is seen how CPU 35 functions as a control means for controlling the ribbon shifting means (stepping motor 20) and the separating means (carriage motor 34) based upon externally supplied data (color cords) which indicates a color to be used during a print operation, wherein the control means calculates a shift amount by which a multicolor ribbon must be shifted based on the color to be printed, and controls the separating means to separate the ribbon from the print paper 4 prior to controlling the ribbon shifting means to shift the multicolor ribbon if the calculated shift amount is greater than a reference shift amount. In particular, the control means (CPU 35) determines a current widthwise position of the multicolor ribbon and a next widthwise position of the multicolor ribbon to which the multicolor ribbon must be shifted in order to print with a desired color, and calculates the shift amount based upon the difference between the current and next shift positions. The control means then evaluates the shift amount by comparing the shift amount to the reference shift amount and determines whether the separating means should be operated before operating the ribbon shifting means.

After completion of the ribbon shift process, the CPU 35 executes a print process according to a well-known technique. Furthermore, after the completion of the ribbon shift process, the CPU 35 can move the printhead 5 to a start position for performing overlap print, instead of performing the process of S9, when an overlap print operation is to be performed. When an overlap print operation is performed, printing can be performed at the same point with different colors in overlapping fashion so as to print a color which is not provided on multicolor ribbon 13. Additionally, an overlap print operation can be used when printing different characters in the same line in different colors (for example, some characters are printed to be red, while others are printed to be black).

It is understood that the present invention is not limited to the embodiment described above. Various modifications can be made thereto without departing from the scope of the invention as defined by the attached claims.

As an alternative to the CPU (which uses a program to compare the calculated shift amount to a reference shift amount), a comparator can also be used to compare the calculated shift amount to the reference shift amount.

In the described embodiment, the use of a four-color multicolor ribbon 13 is described. Additionally, this invention is applicable to the use of a two-color ribbon consisting of, for example, black and red regions provided in a ratio of 3:1 in the widthwise direction of the ribbon. Namely, this invention is applicable to any printer where a shift amount of ribbon is not constant (i.e., the ribbon can be shifted by large and small amounts).

In the embodiment described above, the printhead 5 is returned to the home position in order to separate the multicolor ribbon 13 from the print paper 4, however the printhead 5 may also be moved in a direction away from the platen 2 to achieve separation therefrom. This technique is particularly effective in a thermal transfer type printer which is already provided with a mechanism for moving the printhead away from the platen for other purposes. Accordingly, the means for separating the multicolor ribbon 13 from print paper 4 can alternatively be a mechanism for moving the printhead (and associated ribbon shifting mechanism) away from the print paper 4.

Although the current position of the multicolor ribbon 13 is detected by calculating the step number P1 necessary for the drive of the stepping motor 20 in this embodiment, it may be detected by a sensor for detecting the rotary position of the stepping motor 20 or the ribbon guide 6, or by a sensor for directly detecting the position of the multicolor ribbon 13. When a sensor for detecting the rotary position of the ribbon guide 6 or a sensor for directly detecting the position of the multicolor ribbon 13 is provided, the current position of the multicolor ribbon 13 can be detected precisely even if the ribbon guide 6 is moved due to exchange of the ribbon cassette 14 after turning-on of the printer.

In the described embodiment, the ribbon cassette 14 is housed in the unit case 50. This invention is, however, practicable for printers where the ribbon cassette is fixed to the carriage to move together with the printhead.

What is claimed is:

1. A multicolor printing apparatus for printing color images on a print paper by using a multicolor ribbon having a plurality of color regions arranged in stripes in a widthwise direction of the multicolor ribbon, comprising:

means for shifting the multicolor ribbon in the widthwise direction thereof to change a color to be printed;

means for separating the multicolor ribbon from the print paper; and means for controlling the means for shifting and the means for separating, said means for controlling includes means for calculating a shift amount by which the multi-color ribbon must be shifted to print a desired color, and means for controlling the means for separating and the means for shifting so that the multicolor ribbon is not separated from the print paper when the calculated shift amount is a non-zero amount less than a reference shift amount, and the multicolor ribbon is separated from the print paper when the calculated shift amount is greater than the reference shift amount.

2. The apparatus of claim 1, wherein said means for controlling determines whether to control said means for separating to cause the multicolor ribbon to be separated from the print paper prior to controlling said means for shifting to cause said multicolor ribbon to be shifted to the next widthwise position based on the shift amount.

3. The apparatus of claim 1, wherein said means for controlling calculates the shift amount based upon supplied data which indicates the desired color to be printed.

4. The apparatus of claim 1, wherein said means for controlling calculates the shift amount by determining a current widthwise position of the multicolor ribbon and a next widthwise position of the multicolor ribbon to which the multicolor ribbon must be shifted to print the desired color, and by calculating a difference between the current and next widthwise positions.

5. The apparatus of claim 1, further comprising:

a printhead; and a carriage on which said printhead and said means for shifting are mounted, said carriage being movably supported between a printing position in which the multicolor ribbon is opposed closely adjacent to the print paper and a home position in which the multicolor ribbon is separated further away from the print paper than in the printing position, wherein said means for separating moves said carriage from the printing position to the home position to separate the multicolor ribbon from the print paper.

6. The apparatus of claim 5, wherein said means for shifting shifts the multicolor ribbon in the widthwise direction while said carriage is located in said printing position when said calculated shift amount is less than said reference shift amount.

7. A multicolor printing apparatus for printing color images on a print paper by using a multicolor ribbon having a plurality of color regions arranged in stripes in a widthwise direction of the multicolor ribbon, comprising:

means for shifting the multicolor ribbon in the widthwise direction thereof to change a color to be printed;

means for separating the multicolor ribbon from the print paper; and means for controlling the means for shifting and the means for separating so that when a color to be printed is to be changed, the means for separating separates the multicolor ribbon from the print paper before the means for shifting shifts the multicolor ribbon in the widthwise direction when a shift amount which the multicolor ribbon must be shifted in said widthwise direction to change said color is greater than a reference shift amount and the means for separating does not separate the multicolor ribbon from the print paper before the means for shifting shifts the multicolor ribbon in the widthwise direction when the shift amount which the multicolor ribbon must be shifted in said widthwise direction to change said color is less than said reference shift amount.

8. The apparatus of claim 7, further comprising:

a printhead; and a carriage on which said printhead and said means for shifting are mounted, said carriage being movably supported between a printing position in which the multicolor ribbon is opposed closely adjacent to the print paper and a home position in which the multicolor ribbon is separated further away from the print paper than in the printing position, wherein said means for separating moves aid carriage from the printing position to the home position to separate the multicolor ribbon from the print paper.

9. The apparatus of claim 8, wherein said means for shifting shifts the multicolor ribbon in the widthwise direction while said carriage is located in said printing position when said calculated shift amount is less than said reference shift amount.

10. A multicolor printing apparatus for printing color images on a print paper by using a multicolor ribbon having a plurality of color regions arranged in stripes in a widthwise direction of the multicolor ribbon, comprising:

a printhead;

means for shifting the multicolor ribbon in the widthwise direction thereof to change a color to be printed;

means for separating the multicolor ribbon from the print paper; and means for controlling the means for shifting and the means for separating, said means for controlling including means for determining current widthwise position of the multicolor ribbon and a next widthwise position of the multicolor ribbon to which the multicolor ribbon must be shifted to change a desired color to be printed, and means for calculating a shift amount of the multicolor ribbon based on the determined current and next widthwise positions, and means for controlling the means for shifting and the means for separating so that the multicolor ribbon is not separated from the print paper when the calculated shift amount required to change the desired color to be printed is less than a reference shift amount, and the multicolor ribbon is separated from the print paper when the calculated shift amount is greater than the reference shift amount.

11. The apparatus of claim 10, wherein said means for controlling determines whether to control said means for separating to cause the multicolor ribbon to be separated from the print paper prior to controlling said means for shifting to cause said multicolor ribbon to be shifted to the next widthwise position based on the shift amount.

12. The apparatus of claim 10, further comprising:

a carriage on which said printhead and said means for shifting are mounted, said carriage being movably supported between a printing position in which the multicolor ribbon is opposed closely adjacent to the print paper and a home position in which the multicolor ribbon is separated further away from the print paper than in the printing position, wherein said means for separating moves said carriage from the printing position to the home position to separate the multicolor ribbon from the print paper.

13. The apparatus of claim 12, further comprising:

means for inhibiting the print paper from intruding into the home position.

14. The apparatus of claim 12, wherein said means for shifting shifts the multicolor ribbon in the widthwise direction while said carriage is located in said printing position when said calculated shift amount is less than said reference shift amount.

15. The apparatus of claim 10, wherein said means for controlling determines the next widthwise position based upon supplied data which indicates the desired color to be printed.

* * * * *